US005938630A

United States Patent [19]

Yen

[11] Patent Number: 5,938,630

[45] Date of Patent: Aug. 17, 1999

[54] LIMB GUARD HAVING A ONE-PIECE IMPACT ABSORBING MEMBER WITH CONSECUTIVE BOX PLEATS

[75] Inventor: Dale Yen, Taipei Hsien, Taiwan

[73] Assignee: Comax Sporting Goods Co., Ltd., Taipei, Taiwan

[21] Appl. No.: 09/012,298

[22] Filed: Jan. 23, 1998

[51] Int. Cl.[6] ..... A61F 5/00; A61F 5/37; A41D 13/00

[52] U.S. Cl. ..... 602/23; 128/882; 2/22

[58] Field of Search ..... 602/3, 5, 6, 23, 602/60–62; 128/882; 2/22–24

[56] References Cited

U.S. PATENT DOCUMENTS

| | | | |
|---|---|---|---|
| 1,744,384 | 1/1930 | Hood | 2/22 |
| 1,758,260 | 5/1930 | Knischewsky | 2/22 |
| 2,338,424 | 1/1944 | Giardini | 2/22 |
| 3,533,106 | 10/1970 | Kremp | 2/22 |
| 5,717,996 | 2/1998 | Feldmann | 2/22 |

*Primary Examiner*—Jerome Donnelly
*Assistant Examiner*—Denise Pothier
*Attorney, Agent, or Firm*—Panitch Schwarze Jacobs & Nadel, P.C.

[57] ABSTRACT

A limb guard for protecting a part of a limb from an external impact force includes an elongate pad member to shield the part of the limb, and a one-piece resilient impact absorbing member. The pad member extends in a lengthwise direction of the limb and has a rear surface to face the limb, and a front surface. The impact absorbing member is disposed upon the pad member, and includes two lateral end portions and a plurality of cushioning units in the form of consecutive box pleats between the lateral end portions. Each of the cushioning units includes a pair of outer folded lateral edges on a front side thereof facing the lateral end portions respectively, a front elongate portion between the outer folded lateral edges to bear the external impact force, a pair of inner folded lateral edges on a rear side thereof, and a rear elongate portion disposed between adjacent inner folded lateral edges of adjacent cushioning units to abut against the front surface of the pad member when the front elongate portion is subjected to impact.

2 Claims, 4 Drawing Sheets

LIMB GUARD HAVING A ONE-PIECE IMPACT ABSORBING MEMBER WITH CONSECUTIVE BOX PLEATS

BACKGROUND OF THE INVENTION

1. Field of the Invention

The invention relates to a limb guard for protecting a part of a limb, more particularly to a limb guard which includes a one-piece impact absorbing member with consecutive box pleats that are capable of providing a high impact absorbing effect.

2. Description of the Related Art

Referring to FIG. 1, a first conventional limb guard for protecting a part of a limb from an external impact force is shown to include an elongate pad member 11 and a one-piece resilient impact absorbing member 10.

As illustrated, the pad member 11 which is made from a soft and flexible material, includes an abutment inner layer 111 adapted to be wrapped around a part of the limb in a lengthwise direction of the limb to shield the latter, a cushion outer layer 112 stitched to the inner layer 111 to form a receiving space for accommodating the impact absorbing member 10 such that the latter can absorb the external impact applied on the pad member 11. The impact absorbing member 10 has a fixed radius of curvature and is made from substantially pliable material. However, the flexibility of the impact absorbing member 10 is limited, and the lateral end portions thereof are not capable of bending to match the lateral end portions of the pad member 11. As such, when the conventional limb guard is wrapped around the limb, the curvature of the impact absorbing member 10 cannot fit the user's limb suitably.

In order to obviate the drawback resulting from the first conventional limb guard, a second conventional limb guard has been proposed. As shown in FIG. 2, the pad member 11 is formed as a carrying bag 15 with a plurality of elongate chambers 13 which extend in a lengthwise of the limb upon which the pad member 11 is to be fastened. The impact absorbing member includes a plurality of impact absorbing elements 14 disposed in the chambers 13 respectively in such a manner that the second conventional limb guard can provide sufficient flexibility to fit the radius of curvature of the user's limbs. However, the impact absorbing effects provided thereby is relatively poor.

SUMMARY OF THE INVENTION

The object of this invention is to provide a limb guard for protecting a part of a limb from an external impact force and which includes a one-piece impact absorbing member with consecutive box pleats such that the box pleats provide high flexibility to fit the curvature of an individual limb in addition to an enhanced impact absorbing effect.

Accordingly, the limb guard of this invention is used to protect a part of a limb from an external impact force and includes an elongate pad member and a resilient impact absorbing member of one-piece structure. The elongate pad member is adapted to shield the part of limb and is adapted to extend in a lengthwise direction of the limb. The pad member has a rear surface adapted to face the part of the limb, and a front surface. The impact absorbing member is disposed upon the pad member and extends in a longitudinal direction relative to the lengthwise direction. The impact absorbing member includes two lateral end portions attached to the pad member along the longitudinal direction, and a plurality of cushioning units in the form of consecutive box pleats which are interposed between the lateral end portions along a transverse direction relative to the longitudinal direction. Each of the cushioning units includes a pair of outer folded lateral edges on a front side thereof which face the lateral end portions respectively, a front elongate portion disposed between the pair of outer folded lateral edges and adapted to bear the external impact force, a pair of inner folded lateral edges on a rear side thereof, and a rear elongate portion disposed between adjacent ones of the inner folded lateral edges of adjacent ones of the cushioning units to abut against the front surface of the pad member when the front elongate portion is subjected to impact.

Since the consecutive box pleats can effectively absorb the external impact force, only a small amount of the impact force is transmitted to the part of the limb.

BRIEF DESCRIPTION OF THE DRAWINGS

Other features and advantages of this invention will become more apparent in the following detailed description of the preferred embodiment with reference to the accompanying drawings, in which.

DETAILED DESCRIPTION OF THE PREFERRED EMBODIMENT

Figure 1:
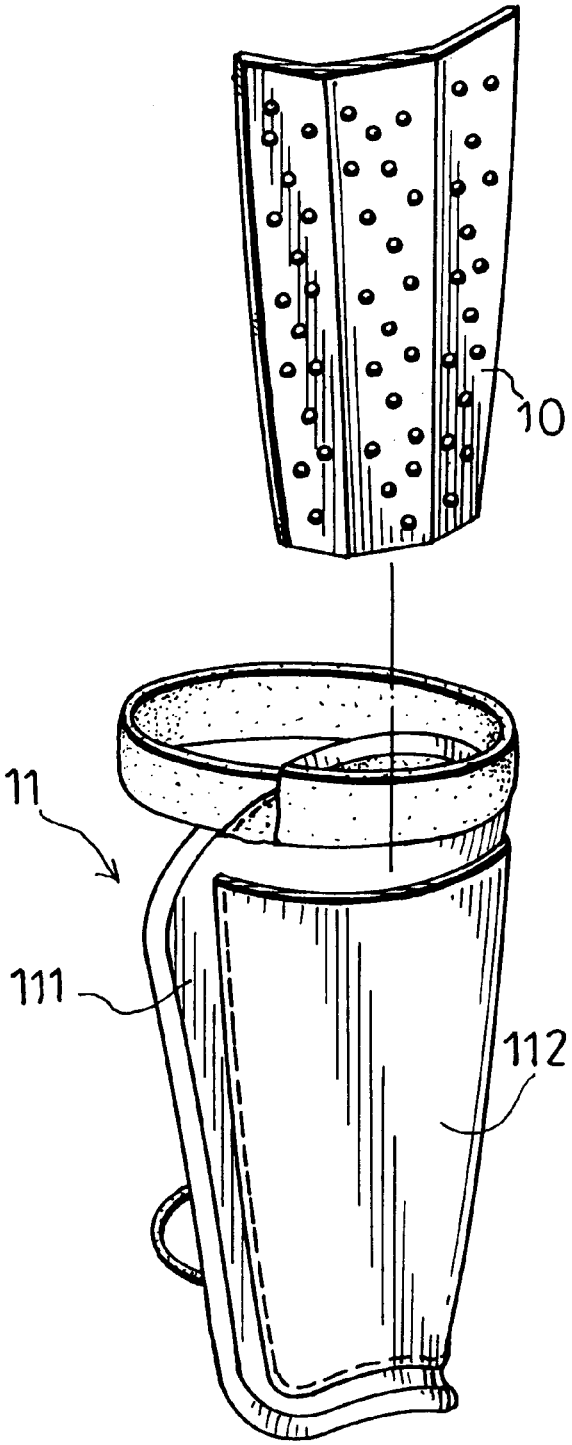
FIG. 1 PRIOR ART
FIG. 1 is a schematic view of a first conventional limb guard, illustrating a state prior to inserting an impact absorbing member into a pad member for fastening around a part of a limb.
Figure 2:
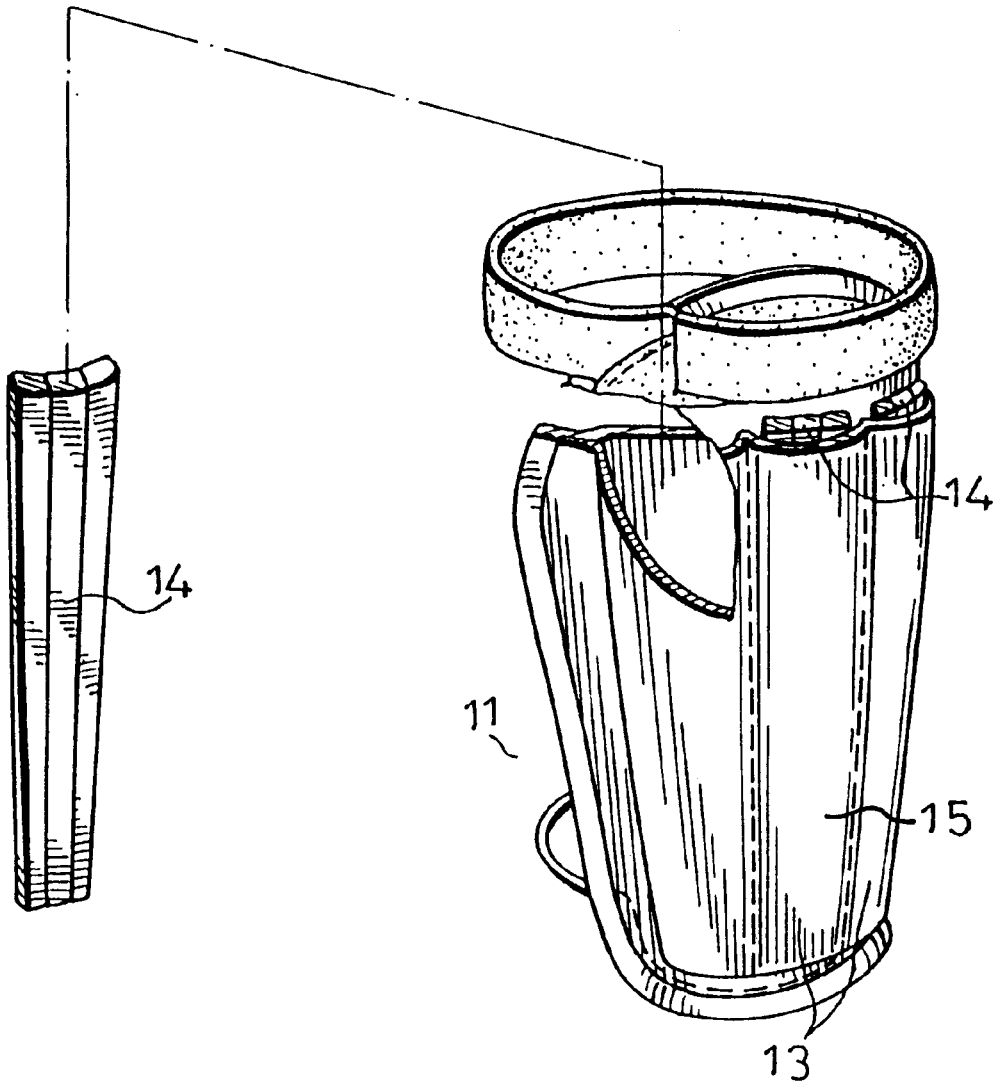
FIG. 2 PRIOR ART
FIG. 2 is a schematic view of a second conventional limb guard, wherein one of the impact absorbing elements is removed from a carrying bag for the sake of clarity.
Figure 3:
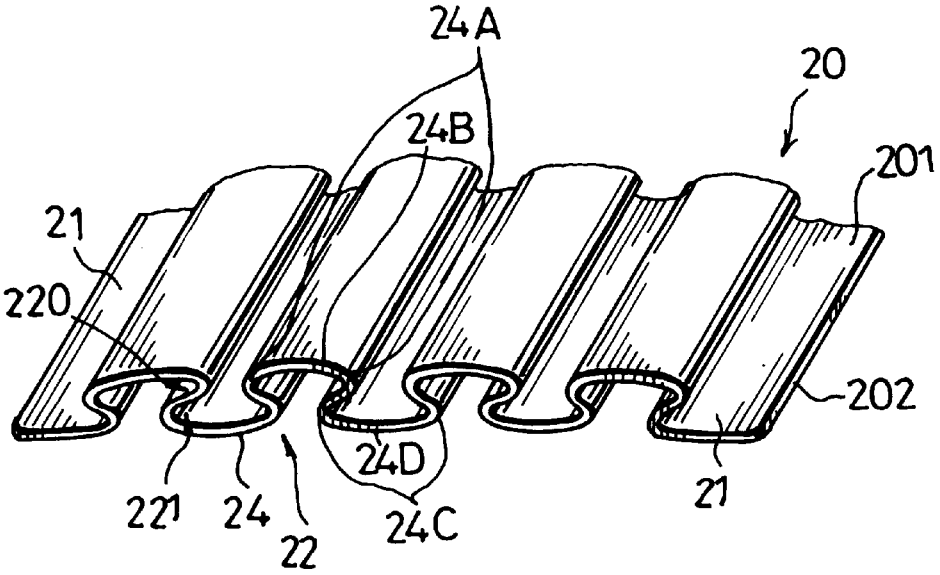
FIG. 3 is a schematic, perspective view of an impact absorbing member employed in a preferred embodiment of a limb guard according to this invention.
Figure 6:
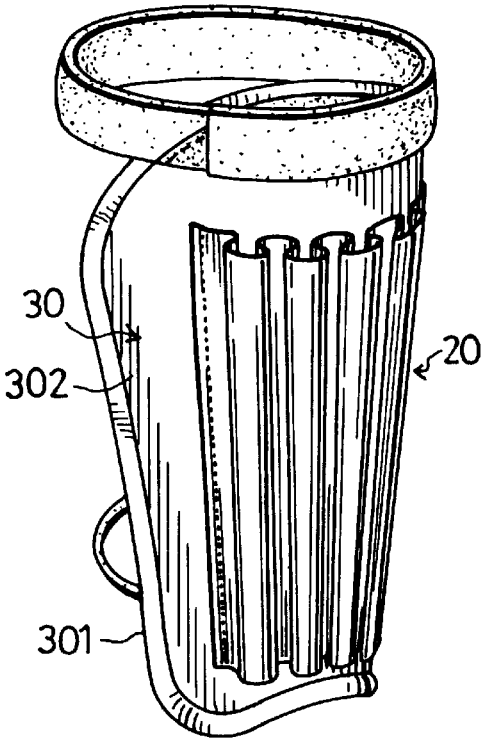
FIG. 6 is a perspective view of the preferred embodiment.

Referring to FIGS. 3 and 6, the preferred embodiment of a limb guard according to this invention is used to protect a part of a limb from an external impact force and is shown to include an elongate pad member 30 and a resilient impact absorbing member 20 of one-piece structure.

As illustrated, the elongate pad member 30 is adapted to shield the part of the limb (not shown) and is adapted to extend in a lengthwise direction of the part of the limb. The pad member 30 has a rear surface 301 adapted to face the part of the limb, and a front surface 302.

Figure 4:
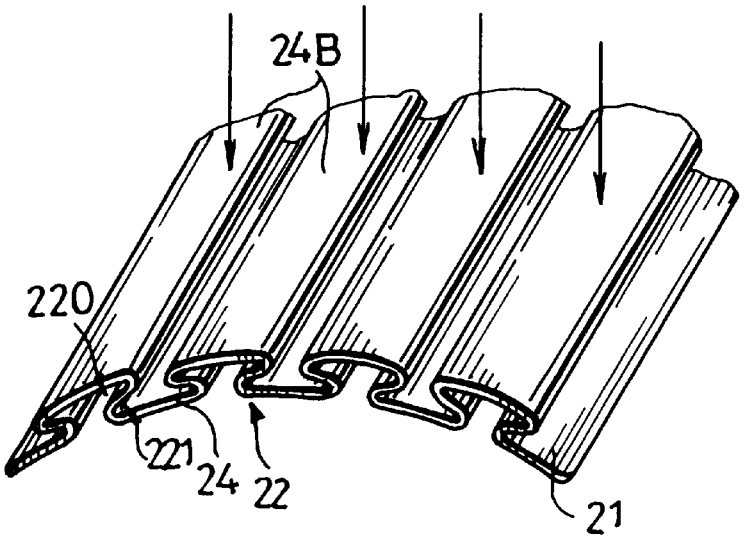
FIG. 4 illustrates how the impact absorbing member of the preferred embodiment deforms upon application of an external impact force thereon.

The resilient impact absorbing member 20 is disposed upon the elongate pad member 30 and extends in a longitudinal direction relative to the lengthwise direction. The impact absorbing member 20 includes two lateral end portions 21 at opposite ends thereof, and a plurality of cushioning units 22 in the form of consecutive box pleats 24 which are interposed between the lateral end portions 21 along a transverse direction relative to the longitudinal direction. The lateral portions 21 of the impact absorbing member 20 are attached to the elongate pad member 30 along the longitudinal direction. Each of the cushioning units 22 of the impact absorbing member 20 includes a pair of outer folded lateral edges 24A on a front side 201 thereof which face the lateral end portions 21 respectively, a front elongate portion 24B disposed between the pair of outer folded lateral edges 24A adapted to bear the external impact force, a pair of inner folded lateral edges 24C on a rear side 202 thereof, and a rear elongate portion 24D disposed between adjacent inner folded lateral edges 24C of adjacent cushioning units 22 to abut against the front surface 302 of the pad member 30. As illustrated in FIG. 4, when the front elongate portion 24B is subjected to impact, two voids 220, 221, which are formed between an adjacent pair of the front and rear elongate portions 24B, 24D, cooperatively provide double cushioning effects, thereby absorbing a greater amount of the external impact force such that only a small amount of the external impact force reaches the elongate pad member 30.

Figure 5:
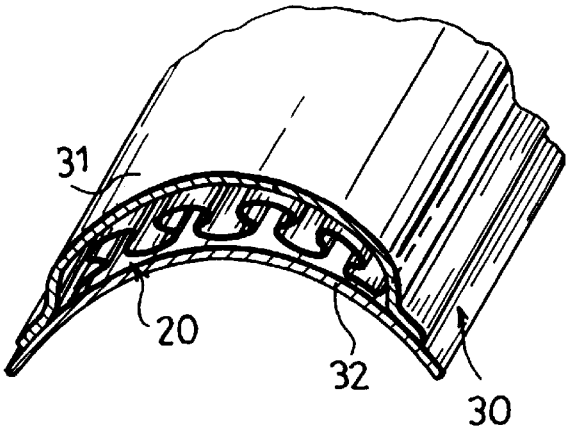
FIG. 5 is a sectional view of the preferred embodiment.

Referring to FIG. 5, in the preferred embodiment, the elongate pad member 30 includes an inner layer 32 and an outer layer 31 stitched to the inner layer 32 to form an accommodating space therebetween. The pad member 30 is adapted to be fastened around the part of the limb by means of a suitable fastener, such as Velcro straps, and the impact absorbing member 20 is disposed in the accommodating space. The impact absorbing member 20 is preferably made of plastic and is produced generally by extrusion in longitudinal form so that a desired length thereof can be cut off to suit the intended application.

With this invention thus explained, it is apparent that numerous modifications and variations can be made without departing from the scope and spirit of this invention. It is therefore intended that this invention be limited only as indicated in the appended claims.

I claim:

1. A limb guard for protecting a part of a limb from an external impact force, comprising:

an elongate pad member adapted to shield the part of the limb, and adapted to extend a length, a rear surface adapted to face the part of the limb, and a front surface; and a resilient impact absorbing member of one-piece structure disposed upon said elongate pad member and extending along length of, said impact absorbing member including:

two lateral sides at opposite ends thereof, and attached along said length of said elongate pad member; and a plurality of cushioning units in a form of consecutive box pleats which are interposed between said lateral sides and along a transverse direction relative to said length, each of said cushioning units including:

first and second outer folded lateral edge portions on a front side thereof facing said two lateral sides respectively;

a front elongate portion disposed between said first and second outer folded lateral edge portions and adapted to bear the external impact force; and first and second inner folded lateral edge portions on a rear side thereof, said first and second inner folded lateral edge portions being integrally formed with said first and second outer folded lateral edge portions respectively; and first and second rear elongate portions extending from said first and second inner folded lateral edges respectively, to abut against said front surface of said pad member when said front elongate portion is subjected to impact, the first and second inner and outer folded lateral edge portions being integrally formed and configured such that the front elongate portion at least partially overlaps said first and second rear elongate portions to create overlappling voids therebetween.

2. The limb guard as defined in claim 1, wherein said pad member includes an inner layer and an outer layer stitched to said inner layer to define an accommodating space therebetween for accommodating said impact absorbing member.

* * * * *